US012544823B2

(12) United States Patent
Grainger

(10) Patent No.: US 12,544,823 B2
(45) Date of Patent: Feb. 10, 2026

(54) RAM SUPPORT ASSEMBLY FOR A CAN BODYMAKER AND CAN BODYMAKER INCLUDING SAME

(71) Applicant: Stolle Machinery Company, LLC, Centennial, CO (US)

(72) Inventor: John Nigel Grainger, Steeton (GB)

(73) Assignee: Stolle Machinery Company, LLC, Centennial, CO (US)

( * ) Notice: Subject to any disclaimer, the term of this patent is extended or adjusted under 35 U.S.C. 154(b) by 273 days.

(21) Appl. No.: 18/085,030

(22) Filed: Dec. 20, 2022

(65) Prior Publication Data

US 2024/0198409 A1 Jun. 20, 2024

(51) Int. Cl.

| | |
|---|---|
| ***B21D 51/26*** | (2006.01) |
| ***B21D 22/28*** | (2006.01) |
| ***B21D 37/01*** | (2006.01) |
| ***B21D 37/16*** | (2006.01) |

(52) U.S. Cl.

CPC ..... *B21D 51/2692* (2013.01); *B21D 22/286* (2013.01); *B21D 37/01* (2013.01); *B21D 37/16* (2013.01)

(58) Field of Classification Search

CPC ..... B21D 22/28; B21D 22/286; B21D 22/30; B21D 22/21; B30B 1/26; B30B 1/268; B30B 1/14; B30B 15/041

See application file for complete search history.

(56) References Cited

U.S. PATENT DOCUMENTS

| | | | | |
|---|---|---|---|---|
| 3,289,453 | A | 12/1966 | Wylie et al. | |
| 3,696,657 | A * | 10/1972 | Maytag | B30B 1/26 72/450 |
| 4,934,167 | A | 6/1990 | Grims et al. | |
| 5,138,862 | A | 8/1992 | Chasteen et al. | |
| 7,526,937 | B2 * | 5/2009 | Zauhar | B21D 22/30 413/69 |
| 9,533,338 | B2 | 1/2017 | Butcher et al. | |
| 2013/0216334 | A1 | 8/2013 | An et al. | |
| 2013/0291611 | A1 * | 11/2013 | Blue | B21D 22/28 72/347 |
| 2017/0087620 | A1 * | 3/2017 | Goff | A61F 2/95 |
| 2022/0258984 | A1 * | 8/2022 | Hoellriegl | B65G 47/847 |

* cited by examiner

*Primary Examiner* — Debra M Sullivan

(74) *Attorney, Agent, or Firm* — Eckert Seamans Cherin & Mellott, LLC

(57) ABSTRACT

A ram support assembly for use in a can bodymaker includes a yolk body for coupling with an end of a ram body of a ram extending from a first side of the yolk body. The yolk body is configured to be coupled to, and be driven by, an operating mechanism of the can bodymaker that is coupled to a second side of the yolk body opposite the first side via a connection arrangement. The ram support assembly also includes a slide arrangement coupled to the yolk body and configured to be coupled to a frame of the can bodymaker such that the yolk body can move linearly with respect to the frame. The slide arrangement includes: a number of rails, and a number of carriage members, wherein each rail of the number of rails has at least one carriage member of the number of carriage members slidingly engaged therewith.

18 Claims, 6 Drawing Sheets

RAM SUPPORT ASSEMBLY FOR A CAN BODYMAKER AND CAN BODYMAKER INCLUDING SAME

FIELD OF THE INVENTION

The disclosed concept relates generally to machinery and, more particularly, to can bodymakers for producing can bodies used in the food and beverage packaging industries. More particularly, the disclosed concept relates to ram support assemblies for use in can bodymakers and can bodymakers including such ram support assemblies.

BACKGROUND OF THE INVENTION

Generally, an aluminum can begins as a sheet of aluminum from which a circular blank is cut. The blank is formed into a "cup" having a bottom and a depending sidewall. The cup is fed into a can bodymaker which passes the cup through a toolpack that thins and elongates the cup, thus forming a can body. That is, the cup is disposed on a punch mounted on an elongated ram. The ram is structured to reciprocate and pass the cup through the toolpack which (re)draws and irons the cup. That is, on each forward stroke of the ram, a cup is passed through the toolpack which forms the cup into the can body. Near the start of the return stroke, the now elongated can body is removed from the ram prior to the punch passing backward through the toolpack. A new cup is disposed on the punch prior to the punch passing forward again through the toolpack. Following additional finishing operations, e.g. trimming, washing, printing, etc., each can body is sent to a filler which fills the can body with product. A top is then coupled to, and sealed against, the can body, thereby completing the can.

The toolpack in the can bodymaker has multiple, spaced dies, each die having a substantially circular opening. Each die opening is slightly smaller than the next adjacent upstream die. Thus, when the punch draws the cup through the first die, the redraw die, the aluminum cup is deformed over the substantially cylindrical punch. Because the openings in the subsequent downstream dies of the toolpack have a smaller inner diameter, i.e. a smaller opening, the aluminum cup is thinned as the ram moves the punch and aluminum cup thereon through the rest of the toolpack.

After the cup (now generally in the shape of the can body) has moved through the last die, the cup bottom and sidewall have the desired thickness; the only other deformation required is to shape the bottom of the cup into an inwardly extending (i.e., concave) dome. To accomplish this, the distal end of the punch is concave while at the maximum extension of the ram is a generally convex dome element (having a shaped perimeter) commonly referred to as a "domer." As the ram reaches its maximum extension, the bottom of the can body engages the domer and is deformed into a dome and the bottom perimeter of the can body is shaped as desired (typically angled inwardly so as to increase the strength of the can body and to allow for the resulting cans to be stacked). As the ram withdraws, the can body is stripped off of the end of the punch by injecting air into the center of the ram. The air travels through the ram and exits out of the end of the punch and breaks the can body loose from the punch. Typically, there is also a mechanical stripper, which prevents the can body from staying on the punch as it retracts back through the toolpack. The ram is withdrawn through the toolpack, a new cup is deposited on the punch, and the cycle repeats.

In conventional bodymaker arrangements, the ram is supported by a number of oil fed hydrostatic slides and driven by a mechanical crank and flywheel drive system. Such hydrostatic arrangements require high-levels of oil filtration and large amounts of electrical energy to power the motors to drive the large pumps for slide operation. Additionally, alignment settings with the slides are dependent on the oil temperature, pressure and the proper Lee jet orifices in place. Variations in hydraulic pressure provided to the slides can vary randomly and frequently during normal bodymaker operations producing can bodies, thus causing uncertainties in the alignment of the ram which can drastically affect the production of can bodies.

SUMMARY OF THE INVENTION

The disclosed and claimed concept in one aspect provides for a ram support assembly for use in a can bodymaker. The ram support assembly comprises: a yolk body structured to be coupled to an end of a ram body of a ram extending from a first side of the yolk body and to be coupled to, and be driven by, an operating mechanism of the can bodymaker coupled to a second side of the yolk body opposite the first side via a connection arrangement; and a slide arrangement coupled to the yolk body and structured to be coupled to a frame of the can bodymaker such that the yolk body can move linearly with respect to the frame, the slide arrangement comprising: a number of rails, and a number of carriage members, wherein each rail of the number of rails has at least one carriage member of the number of carriage members slidingly engaged therewith.

Each rail of the number of rails may comprise a hardened steel material. Each carriage member may comprise a plurality of balls and/or rollers engaged with the corresponding rail; and the plurality of balls and/or rollers may comprise a ceramic material.

The number of rails may comprise two rails; and the number of carriage members may comprise at least two carriage members.

The number of rails may comprise two rails; the number of carriage members may comprise four carriage members; each rail of the number of rails may comprise a hardened steel material; each carriage member may comprise a plurality of balls and/or rollers engaged with the corresponding rail; and the plurality of balls and/or rollers may comprise a ceramic material.

The disclosed and claimed concept in in another aspect provides a ram assembly for a can bodymaker. The ram assembly comprises: a ram having an elongated, substantially cylindrical ram body positioned about a longitudinal axis, the ram body having a proximal end and a distal end positioned opposite the proximal end; and a ram support assembly comprising: a yolk body coupled to the proximal end of the ram body such that the ram body is supported by the yolk body and extends from a first side of the yolk body in a cantilevered manner, the yolk body structured to be coupled to, and driven by, an operating mechanism of the can bodymaker via a connection arrangement coupled to a second side of the yolk body opposite the first side; and a slide arrangement coupled to the yolk body and structured to be coupled to a frame of the can bodymaker such that the yolk body can move only linearly with respect to the frame, the slide arrangement comprising: a number of rails, and a number of carriage members, wherein each rail of the number of rails has at least one carriage member of the number of carriage members slidingly engaged therewith.

Each rail of the number of rails may comprise a hardened steel material. Each carriage member may comprise a plurality of balls and/or rollers engaged with the corresponding rail; and the plurality of balls and/or rollers comprises a ceramic material.

The number of rails may comprise two rails and the number of carriage members may comprise at least two carriage members.

The number of rails may comprise two rails; the number of carriage members may comprise two carriage members; each rail of the number of rails may comprise a hardened steel material; each carriage member may comprise a plurality of balls and/or rollers engaged with the corresponding rail; and the plurality of balls and/or rollers may comprise a ceramic material.

The disclosed and claimed concept in yet a further aspect provides a can bodymaker that comprises: a frame; an operating mechanism coupled to the frame; and a ram assembly comprising: a ram having an elongated, substantially cylindrical ram body positioned about a longitudinal axis, the ram body having a proximal end and a distal end positioned opposite the proximal end; and a ram support assembly comprising: a yolk body coupled to the proximal end of the ram body such that the ram body is supported by the yolk body and extends from a first side of the yolk body in a cantilevered manner, the yolk body coupled to and driven by the operating mechanism via a connection arrangement coupled to a second side of the yolk body opposite the first side; and a slide arrangement coupled to the yolk body and to the frame such that the yolk body can move only linearly with respect to the frame, the slide arrangement comprising: a number of rails, and a number of carriage members, wherein each rail of the number of rails has at least one carriage member of the number of carriage members slidingly engaged therewith.

Each rail of the number of rails may comprise a hardened steel material. Each carriage member may comprise a plurality of balls and/or rollers engaged with the corresponding rail; and the plurality of balls and/or rollers may comprise a ceramic material.

The number of rails may comprise two rails and the number of carriage members may comprise at least two carriage members.

The number of rails may comprise two rails; the number of carriage members may comprise four carriage members; each rail of the number of rails may comprise a hardened steel material; each carriage member may comprise a plurality of balls and/or rollers engaged with the corresponding rail; and the plurality of balls and/or rollers may comprise a ceramic material. The number of carriage members may be fixedly coupled to the yolk body; and the number of rails may be fixedly coupled to the frame. The can bodymaker may further comprise a cooling system structured to provide a supply of a coolant to or near the slide arrangement. The coolant may be a gas.

These and other objects, features, and characteristics of the disclosed concept, as well as the methods of operation and functions of the related elements of structure and the combination of parts and economies of manufacture, will become more apparent upon consideration of the following description and the appended claims with reference to the accompanying drawings, all of which form a part of this specification, wherein like reference numerals designate corresponding parts in the various figures. It is to be expressly understood, however, that the drawings are provided for the purpose of illustration and description only and are not intended as a definition of the limits of the concept.

BRIEF DESCRIPTION OF THE DRAWINGS

A full understanding of the disclosed concept can be gained from the following description of the preferred embodiments when read in conjunction with the accompanying drawings in which.

DETAILED DESCRIPTION OF THE INVENTION

Figure 1:
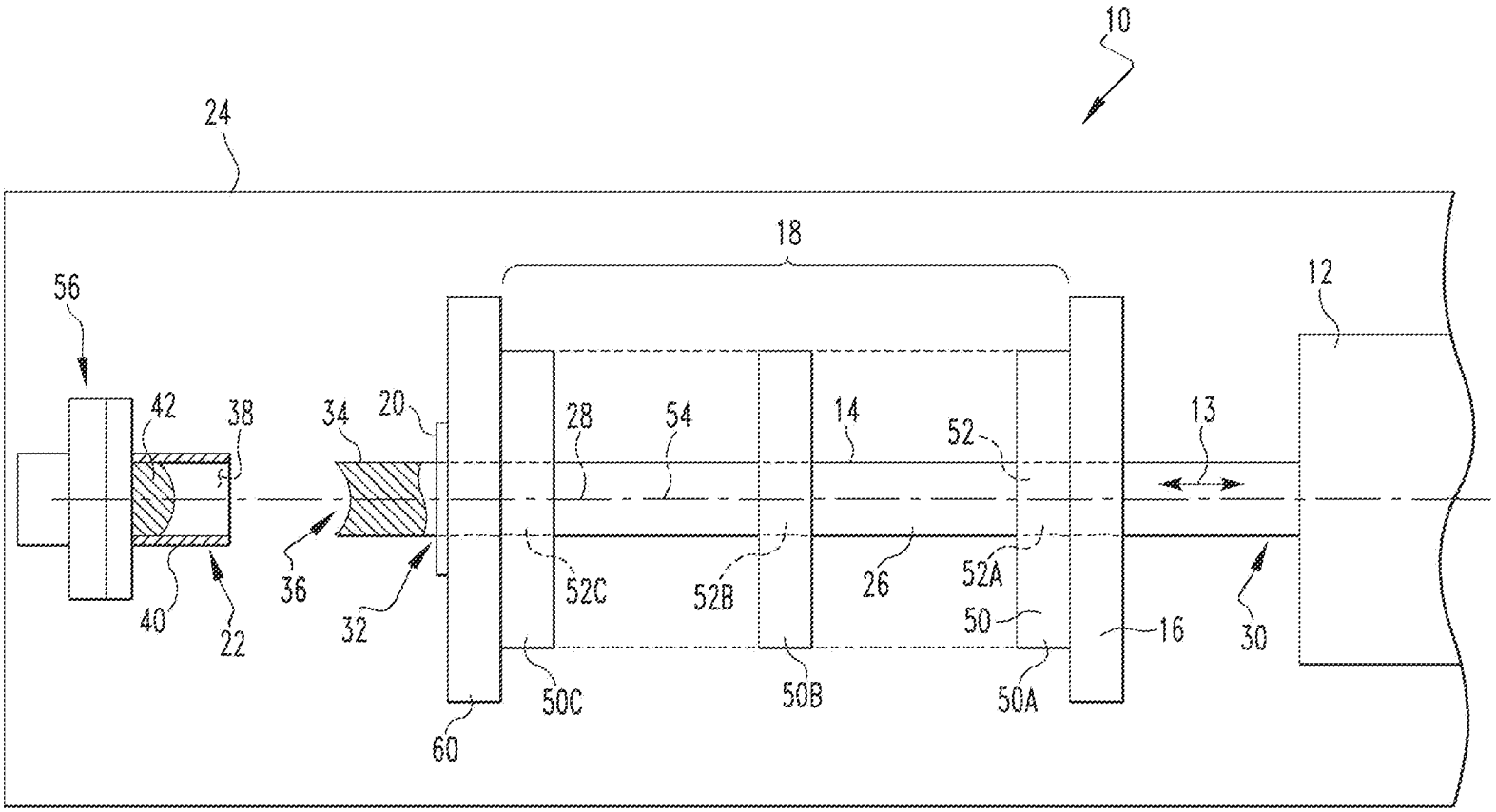
FIG. 1 is a schematic view of a can bodymaker in accordance with an example embodiment of the disclosed concept.

The specific elements illustrated in the drawings and described herein are simply exemplary embodiments of the disclosed concept. Accordingly, specific dimensions, orientations and other physical characteristics related to the embodiments disclosed herein are not to be considered limiting on the scope of the disclosed concept.

As employed herein, the term "can" refers to any known or suitable container, which is structured to contain a substance (e.g., without limitation, liquid; food; any other suitable substance), and expressly includes, but is not limited to, beverage cans, such as beer and soda cans, as well as cans used for food.

As used herein, "coupled" means a link between two or more elements, whether direct or indirect, so long as a link occurs. An object resting on another object held in place only by gravity is not "coupled" to the lower object unless the upper object is otherwise maintained substantially in place. That is, for example, a book on a table is not coupled thereto, but a book glued to a table is coupled thereto.

As used herein, "directly coupled" means that two elements are coupled in direct contact with each other.

As used herein, "fixedly coupled" or "fixed" means that two components are coupled so as to move as one while maintaining a constant orientation relative to each other. The fixed components may, or may not, be directly coupled.

As used herein, the word "unitary" means a component is created as a single piece or unit. That is, a component that includes pieces that are created separately and then coupled together as a unit is not a "unitary" component or body.

As used herein, "associated" means that the identified components are related to each other, contact each other, and/or interact with each other. For example, an automobile has four tires and four hubs, each hub is "associated" with a specific tire.

As used herein, "engage," when used in reference to gears or other components having teeth, means that the teeth of the gears interface with each other and the rotation of one gear causes the other gear to rotate as well.

As employed herein, the term "number" shall mean one or an integer greater than one (i.e., a plurality).

As shown schematically in FIG. 1, a can bodymaker, or can forming machine, 10 in accordance with an example embodiment of the disclosed concept includes an operating mechanism 12 structured to provide a cyclical and/or reciprocating motion (such as shown by the double-headed arrow 13), a ram 14, a load station 16, a die assembly, or toolpack, 18, a can stripper 20, and a domer assembly 22. In such example embodiment, each of the aforementioned components are coupled, directly or indirectly, to a frame, or housing (shown generally as 24), for maintaining such components, and/or selected portions thereof, in a known relationship with respect to one or more of the other of such components.

Continuing to refer to FIG. 1, the ram 14 has an elongated, substantially cylindrical ram body 26 positioned about a longitudinal axis 28 such that ram 14 moves back and forth generally along longitudinal axis 28. The ram body 26 includes a proximal end 30 positioned nearest, and coupled to the operating mechanism 12, and a distal end 32 positioned opposite proximal end 30. A punch 34 is disposed at, or over, the distal end 32 of the ram 14. The punch 34 is a generally cylindrical body with a concave distal end 36 which may be shaped to correspond to a cavity 38 of a domer die 40 of the domer assembly 22. The operating mechanism 12 provides a reciprocal motion to the ram body 26 causing the ram body 26, and therefore the punch 34, to move back and forth along its longitudinal axis 28. That is, the punch 34 is structured to reciprocate between a retracted position, wherein the punch 34 is positioned between the load station 16 and the operating mechanism 12, and an extended position, wherein the ram body extends generally horizontally through the toolpack 18 and the distal end 36 of the punch 34 is disposed adjacent to, and indirectly engaged with via a bottom of a can body positioned on the punch 34, a convex dome formation 42 provided as a portion of, and extending into the cavity 38 thereof, the domer die 40 of the domer assembly 22.

The toolpack 18 includes a number (e.g., without limitation, three are shown in the example) of die(s) 50 (each) having an opening 52 therein. The opening 52A in the first die 50A (the die 50 closest to the operating mechanism 12) is slightly larger than the opening 52B in the second (middle, as shown) die 50B. The opening 52B in the second die 50B is slightly larger than the opening 52C in the third (farthest from the operating mechanism 12) die 50C. The opening(s) 52 of the die(s) 50 are disposed along a common axis 54 that is generally aligned with the longitudinal axis 28 of the ram body 26.

In the configuration shown in FIG. 1, the can bodymaker 10 is structured to transform a cup into a can body, which may later have a top added, forming a can. A cup is disposed on/over the punch 34 by the load station 16 prior to the punch 34 passing forward through the toolpack 18 moving from the retracted position to the extended position such as previously discussed. When the punch 34 pushes the cup through the toolpack 18, ideally the cup is thinned and stretched to a desired length and wall thickness if the opening(s) 52 of the die(s) 50 of the die pack 18 are properly aligned with the path of the punch 34. The elongated cup is a can body.

The domer assembly 22 is disposed at the end of the stroke of the ram body 26. The domer assembly 22 includes the domer die 40 that is coupled to the frame 24 of the can bodymaker 10 by a mounting assembly 56 which may be of any suitable arrangement. The domer die 40 is a body 44 with the cavity 38 defining the convex dome formation 42. The cavity 38 may include other features structured to shape the bottom of the cup. Ideally, the center of the dome formation 42 is substantially aligned with the longitudinal axis 28 of the ram body 26. In such arrangement, when the ram body 26 is at its maximum extension, i.e., in the extended position previously discussed, the cup bottom, that portion of the cup covering the concave distal end 36 of the punch 34, is shaped by the punch 34 entering the cavity 38 of the domer die 40. That is, the cup bottom becomes a dome extending into the can body. After the dome is formed in the newly formed can body still positioned on the punch 34, the ram body 26 begins the rearward portion of the stroke from the extended position back toward the retracted position.

The can stripper 20 is disposed on the outer surface of a stripper bulkhead 60 opposite the toolpack 18. The can stripper 20 removes the can body from the punch 34 after the dome has been formed in the bottom of the can and the ram 14 has begun to move rearward. Thus, the punch 34 travels rearwardly with no cup or other material between the punch 34 and the dies 50 of the toolpack 18.

Having thus described a basic overview of the general parts of a can bodymaker 10 a detailed example embodiment of ram support assembly 100 (in accordance with one example embodiment of the disclosed concept) for use in such a bodymaker 10 will now be described in conjunction with FIGS. 2-6. The ram support assembly 100 comprises a yolk body 102, formed from a suitable rigid material (e.g., without limitation, aluminum, steel, etc.) that is coupled to the proximal end 30 of the ram body 26 such that the ram 14 is supported by the yolk body 102 and extends in a cantilevered manner outward from a first side 102A of the yolk body.

The ram support assembly 100 further comprises a slide arrangement 104 coupled to the yolk body 102 and to the frame 24 of the can bodymaker 10 such that the yolk body 102 can move only linearly (i.e., slide along a linear path, e.g., such as along the common axis 54 shown in FIG. 1) with respect to the frame 24. The slide arrangement 104 includes a number of rails 106 and a corresponding number of carriage members 108, with each rail 106 slidingly engaged with at least one carriage member 108. In the example embodiment shown in FIGS. 2-6, the slide arrangement 102 includes two rails 106 and a total of four carriage members 108, with each rail 106 having two carriage members 108 slidingly engaged therewith. Further, each rail 106 is rigidly coupled to the frame 24 of the bodymaker 10, while each carriage member 108 is rigidly coupled to the yolk body 102 such that each carriage member 108 is slidingly coupled to the frame 24 via a rail 106 and each rail 106 is slidingly coupled to the yolk body 102 via two carriage members 108. It is to be appreciated, that the quantity of rails 106 and/or carriage members 108 (and/or the number of carriage members 108 slidingly engaged with each rail 106) may be varied without varying from the scope of the disclosed concept.

In order to minimize friction between, and wear of, the parts of the slide arrangement 104, each rail 106 is formed wholly or in-part (e.g., the contact surfaces) from, and thus comprises, a hardened steel or other suitable material. Meanwhile, each carriage member 108 comprises a plurality of balls and/or rollers formed from, and thus comprises, a ceramic material or materials that engage with a hardened portion of the corresponding rail. It is also to be appreciated that other suitable materials that enable high speed function, e.g., without limitation hardened steel rollers, hardened steel balls, etc., may be employed in carriage member(s) 108 and/or rail(s) 106 without varying form the scope of the disclosed concept. It is also to be appreciated that by employing such arrangement of rails 106, carriage members 108, and particular materials thereof, very tight/precise tolerances as required for can bodymaking can be readily maintained without the need for any lubricating fluid(s) and supply arrangements associated therewith.

The yolk body 102 is driven in a reciprocal linear motion back and forth along the number of rails 106 of the slide arrangement 104 by the operating mechanism 12 (shown schematically) of the bodymaker 10 via a suitable connection arrangement 110 (also shown schematically) coupling the yolk body 102 (e.g., generally at or near a second side 102B thereof opposite the first side 102A) to the operating mechanism 12.

Figures 2, 3:
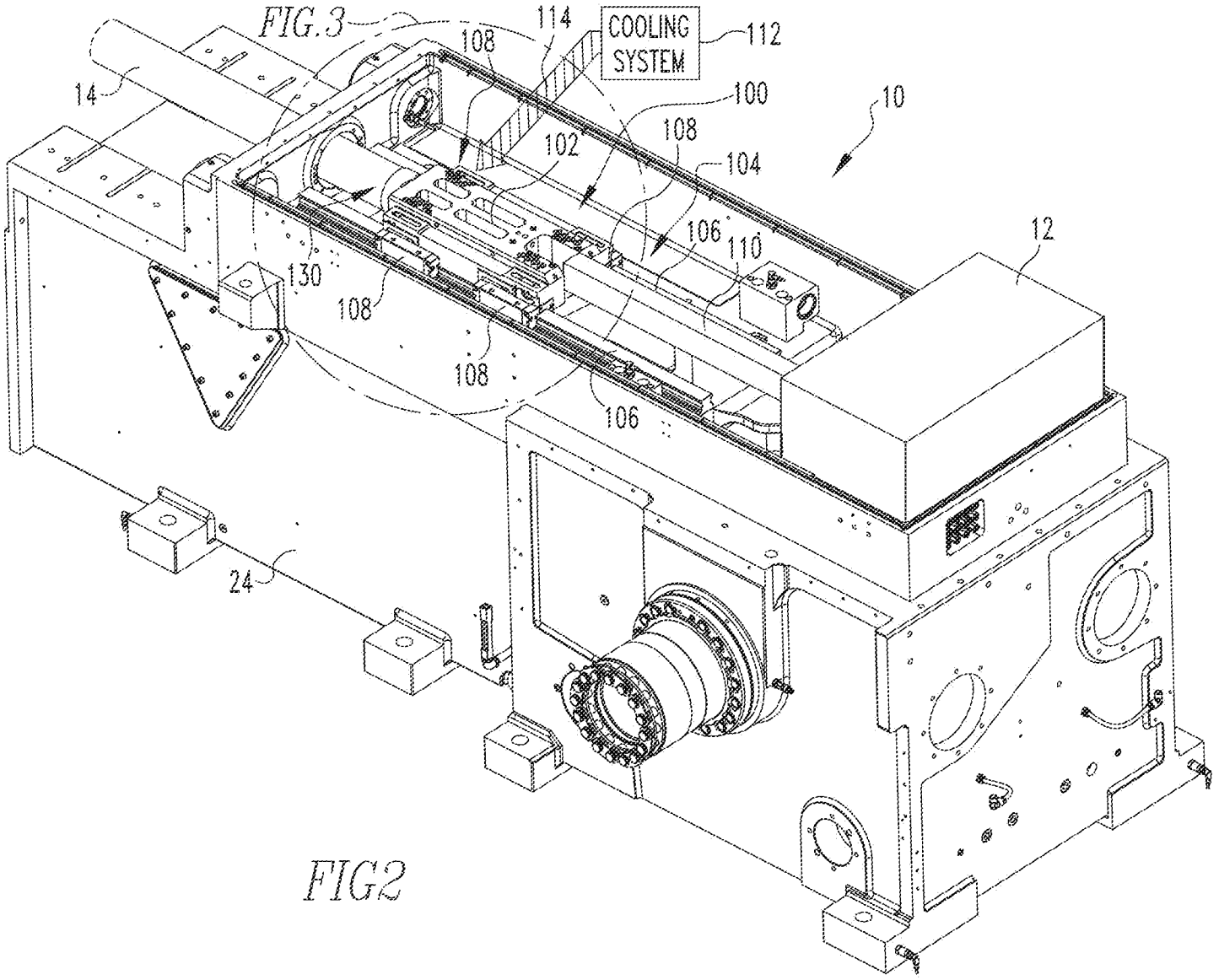
FIG. 2 is a partially schematic perspective view of a portion of a can bodymaker having a ram assembly with a ram support assembly in accordance with one example embodiment of the disclosed concept shown with parts removed to show details of certain components.
FIG. 3 is a detail view of a portion of the view of FIG. 2 as indicated in FIG. 2.
Figure 3:
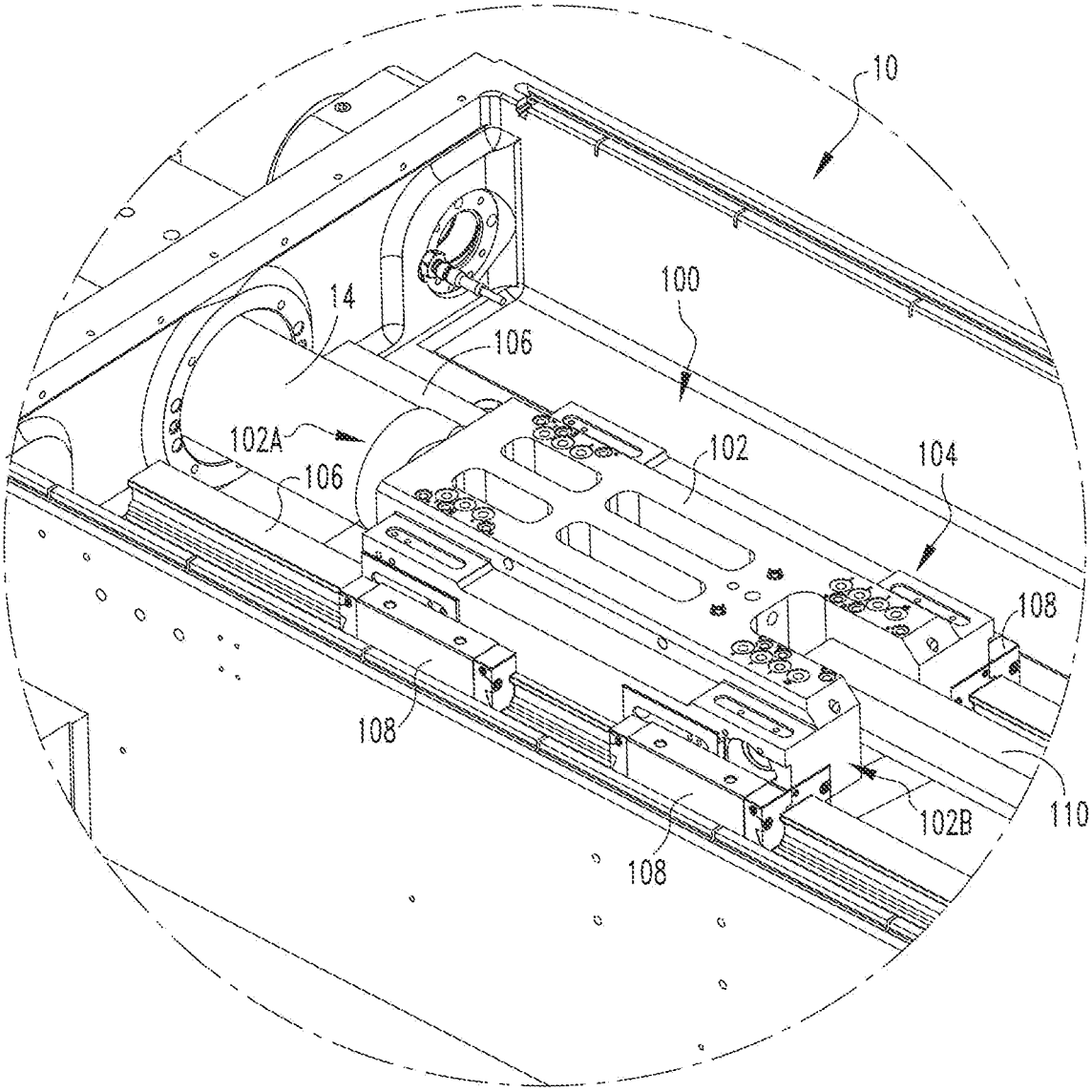
Figure 4:
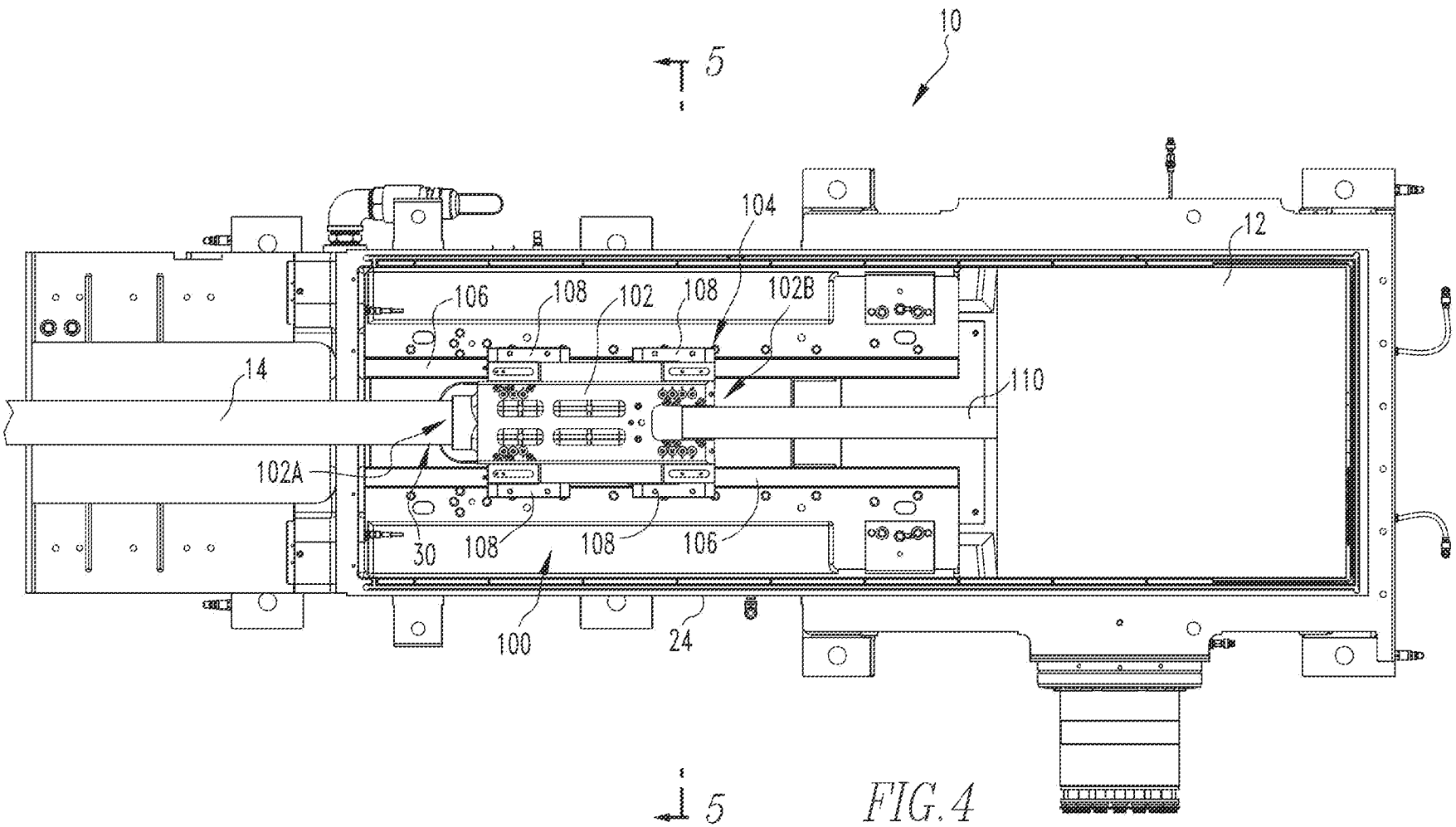
FIG. 4 is a partially schematic top view of the portion of the can bodymaker of FIG. 2.
Figure 5:
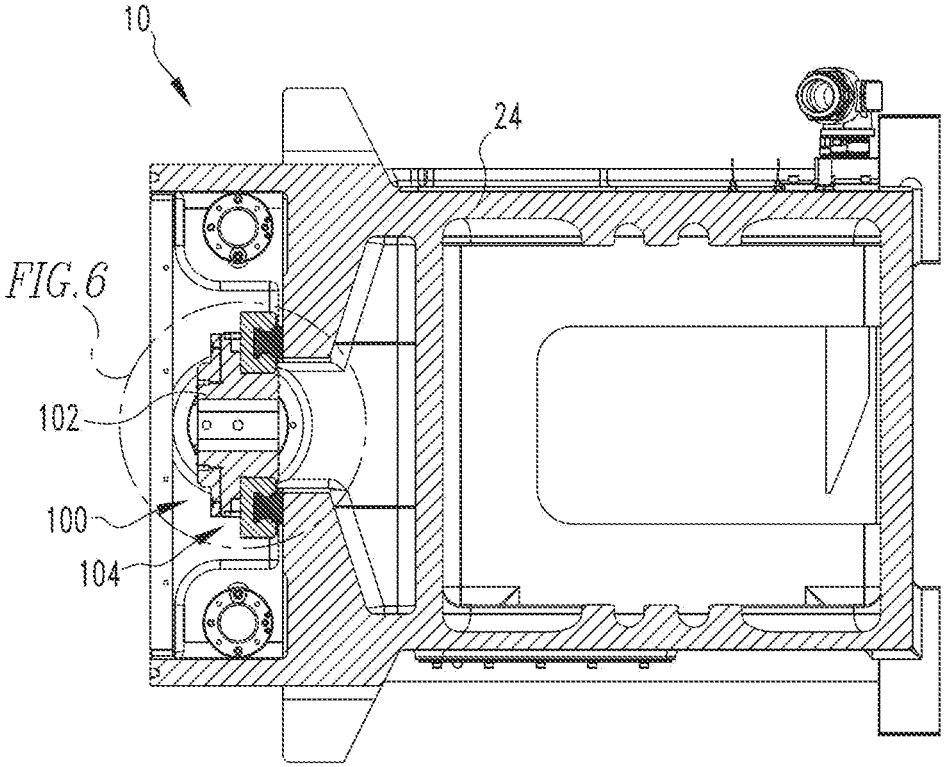
FIG. 5 is a sectional view of the portion of the can bodymaker of FIGS. 1 and 4 taken as indicated in FIG. 4.
Figure 6:
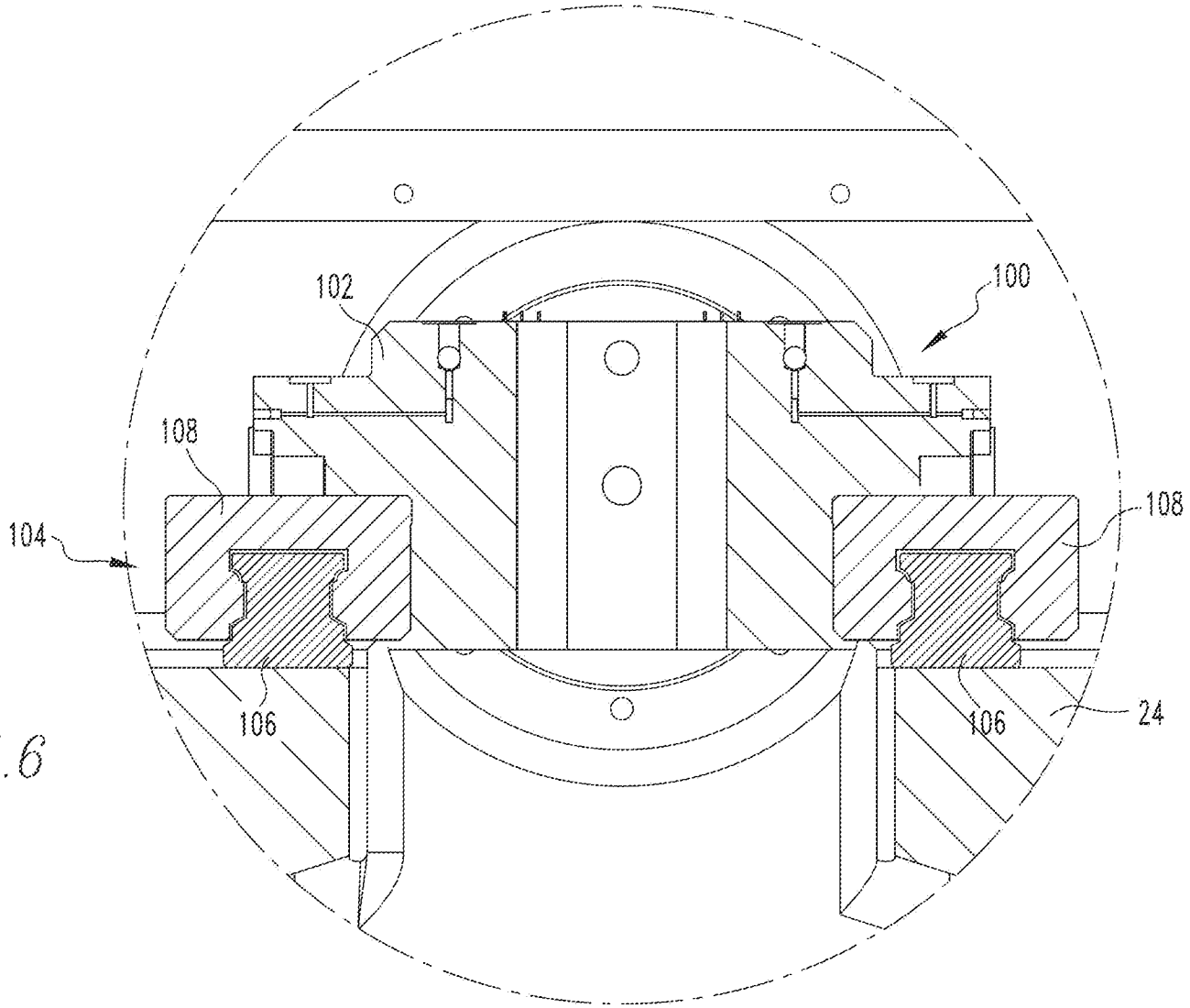
FIG. 6 is a detail view of a portion of the view of FIG. 5 as indicated in FIG. 5.

As shown schematically in FIG. 2, in order to provide for cooling of the slide arrangement 104 and components thereof, a cooling system 112 may be included to provide a supply of a coolant 114 directly to or near the slide arrangement 104. Such coolant 114 may be a suitable gas or liquid. In an example embodiment of the disclosed concept, a number of grease packs provided on-board adjacent yolk body 102 and one or more of carriage members 108 provide a smear of high temp grease to a corresponding rail 106 to reduce friction between rail 106 and the carriage member(s) slidingly engaged therewith.

From the foregoing it is to be appreciated that embodiments of the disclosed concept provide advantages over conventional arrangements such as reduced set-up times, lowered oil consumption, reduced energy costs, reduced cost for oil cooling, reduced failures points, less downtime/improved production efficiency, etc.

While specific embodiments of the disclosed concept invention have been described in detail, it will be appreciated by those skilled in the art that various modifications and alternatives to those details could be developed in light of the overall teachings of the disclosure. Accordingly, the particular arrangements disclosed herein are meant to be illustrative only and not limiting as to the scope of disclosed concept which is to be given the full breadth of the claims appended and any and all equivalents thereof.

In the claims, any reference signs placed between parentheses shall not be construed as limiting the claim. The word "comprising" or "including" does not exclude the presence of elements or steps other than those listed in a claim. In a device claim enumerating several means, several of these means may be embodied by one and the same item of hardware. The word "a" or "an" preceding an element does not exclude the presence of a plurality of such elements. In any device claim enumerating several means, several of these means may be embodied by one and the same item of hardware. The mere fact that certain elements are recited in mutually different dependent claims does not indicate that these elements cannot be used in combination.

What is claimed is:

1. A ram support assembly for use in a can bodymaker, the ram support assembly comprising:

a yolk body structured to be coupled to an end of a ram body of a ram extending from a first side of the yolk body and to be coupled to, and be driven by, an operating mechanism of the can bodymaker coupled to a second side of the yolk body opposite the first side via a connection arrangement; and a slide arrangement coupled to the yolk body and structured to be coupled to a frame of the can bodymaker such that the yolk body can move linearly with respect to the frame, the slide arrangement comprising:

a number of carriage members, each carriage member coupled to the yolk body, and a number of rails, at least a portion of each rail positioned directly below a respective portion of the yolk body when the ram support assembly is in use in the can bodymaker, wherein each rail of the number of rails has at least one carriage member of the number of carriage members slidingly engaged therewith.

2. The ram support assembly of claim 1, wherein each rail of the number of rails comprises a hardened steel material.

3. The ram support assembly of claim 1, wherein:

each carriage member comprises a plurality of balls and/or rollers engaged with the corresponding rail; and the plurality of balls and/or rollers comprise a ceramic material.

4. The ram support assembly of claim 1, wherein:

the number of rails comprises two rails; and the number of carriage members comprises at least two carriage members.

5. The ram support assembly of claim 1, wherein:

the number of rails comprises two rails;

the number of carriage members comprises four carriage members;

each rail of the number of rails comprises a hardened steel material;

each carriage member comprises a plurality of balls and/or rollers engaged with the corresponding rail; and the plurality of balls and/or rollers comprise a ceramic material.

6. A ram assembly for a can bodymaker, the ram assembly comprising:

a ram having an elongated, substantially cylindrical ram body positioned about a longitudinal axis, the ram body having a proximal end and a distal end positioned opposite the proximal end; and a ram support assembly comprising:

a yolk body coupled to the proximal end of the ram body such that the ram body is supported by the yolk body and extends from a first side of the yolk body in a cantilevered manner, the yolk body structured to be coupled to, and driven by, an operating mechanism of the can bodymaker via a connection arrangement coupled to a second side of the yolk body opposite the first side; and a slide arrangement coupled to the yolk body and structured to be coupled to a frame of the can bodymaker such that the yolk body can move only linearly with respect to the frame, the slide arrangement comprising:

a number of carriage members, each carriage member coupled to the yolk body, and a number of rails, at least a portion of each rail positioned directly below a respective portion of the yolk body when the ram support assembly is in use in the can bodymaker, wherein each rail of the number of rails has at least one carriage member of the number of carriage members slidingly engaged therewith.

7. The ram assembly of claim 6, wherein each rail of the number of rails comprises a hardened steel material.

8. The ram assembly of claim 6, wherein:

each carriage member comprises a plurality of balls and/or rollers engaged with the corresponding rail; and the plurality of balls and/or rollers comprises a ceramic material.

9. The ram assembly of claim 6, wherein:

the number of rails comprises two rails; and the number of carriage members comprises at least two carriage members.

10. The ram assembly of claim 6, wherein:

the number of rails comprises two rails;

the number of carriage members comprises two carriage members;

each rail of the number of rails comprises a hardened steel material;

each carriage member comprises a plurality of balls and/or rollers engaged with the corresponding rail; and the plurality of balls and/or rollers comprises a ceramic material.

11. A can bodymaker comprising:

a frame;

an operating mechanism coupled to the frame; and a ram assembly comprising:

a ram having an elongated, substantially cylindrical ram body positioned about a longitudinal axis, the ram body having a proximal end and a distal end positioned opposite the proximal end; and a ram support assembly comprising:

a yolk body coupled to the proximal end of the ram body such that the ram body is supported by the yolk body and extends from a first side of the yolk body in a cantilevered manner, the yolk body coupled to and driven by the operating mechanism via a connection arrangement coupled to a second side of the yolk body opposite the first side; and a slide arrangement coupled to the yolk body and to the frame such that the yolk body can move only linearly with respect to the frame, the slide arrangement comprising:

a number of carriage members, each carriage member coupled to the yolk body, and a number of rails, at least a portion of each rail positioned directly below a respective portion of the yolk body when the ram support assembly is in use in the can bodymaker, wherein each rail of the number of rails has at least one carriage member of the number of carriage members slidingly engaged therewith.

12. The can bodymaker of claim 11, wherein each rail of the number of rails comprises a hardened steel material.

13. The can bodymaker of claim 11, wherein:

each carriage member comprises a plurality of balls and/or rollers engaged with the corresponding rail; and the plurality of balls and/or rollers comprise a ceramic material.

14. The can bodymaker of claim 11, wherein:

the number of rails comprises two rails; and wherein the number of carriage members comprises at least two carriage members.

15. The can bodymaker of claim 11, wherein:

the number of rails comprises two rails;

the number of carriage members comprises four carriage members;

each rail of the number of rails comprises a hardened steel material;

each carriage member comprises a plurality of balls and/or rollers engaged with the corresponding rail; and the plurality of balls and/or rollers comprises a ceramic material.

16. The can bodymaker of claim 15, wherein:

the number of carriage members are fixedly coupled to the yolk body; and the number of rails are fixedly coupled to the frame.

17. The can bodymaker of claim 16, further comprising a cooling system structured to provide a supply of a coolant to or near the slide arrangement.

18. The can bodymaker of claim 17, wherein the coolant is a gas.

* * * * *